US006758549B2

(12) United States Patent
Thiessen et al.

(10) Patent No.: US 6,758,549 B2
(45) Date of Patent: Jul. 6, 2004

(54) CLEANING SYSTEM FOR AN INKJET PRINTHEAD

(75) Inventors: Kurt E. Thiessen, San Diego, CA (US); Antoni Murcia, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/198,276

(22) Filed: Jul. 17, 2002

(65) Prior Publication Data

US 2004/0012650 A1 Jan. 22, 2004

(51) Int. Cl.[7] ..... B41J 2/165
(52) U.S. Cl. ..... 347/33; 347/23
(58) Field of Search ..... 347/33, 22, 23, 347/24, 29, 30, 32, 101, 104

(56) References Cited

U.S. PATENT DOCUMENTS 6,172,691 B1 1/2001 Belon et al.

FOREIGN PATENT DOCUMENTS

| | | |
|---|---|---|
| EP | 1228886 | 4/2003 |
| JP | 2002192778 | 7/2002 |

OTHER PUBLICATIONS

British Search Report dated Dec. 18, 2003.

*Primary Examiner*—Shih-Wen Hsieh

(57) ABSTRACT

The present invention includes as one embodiment a cleaning system for an inkjet printhead, including a wiper and a media detection device coupled to the wiper for activating engagement of the wiper with the printhead when no media is detected and for deactivating the wiper when media contacts the media detection device.

37 Claims, 4 Drawing Sheets

CLEANING SYSTEM FOR AN INKJET PRINTHEAD

BACKGROUND

Cleaning and protecting an inkjet printhead assembly is an aspect relating to proper maintenance of an inkjet printing mechanism, such as a printer or a plotter. Typically, inkjet printing mechanisms include a service station mechanism that is mounted within the printer chassis for cleaning and protecting the inkjet printhead assembly. In operation, the printhead assembly is moved over the station to allow certain predefined maintenance operations to be performed.

A wiper system is usually included in a service station and is used during printing periods. One type of wiper system uses a biasing force to push a wiper blade into engagement with the printhead to enable wiping of the printhead. The wiping removes accumulated debris and ink spatter from the nozzles. However, this pushing involves using a relative amount of force, which can change the alignment of the printhead assembly.

Further, wiper systems can contribute significantly to the width of a printer. Reducing the overall width of the printer is desirable because consumer demand has increased for smaller home and office printers and compact living room printers for entertainment systems. In addition, since control over certain aspects of the printhead assembly can be expensive, such as the size of the printhead or the expense of electrical components incorporated into the design, service stations that do not take these other components into consideration can increase the overall printhead assembly manufacturing costs.

SUMMARY OF THE INVENTION

The present invention includes as one embodiment a cleaning system for an inkjet printhead, including a wiper and a media detection device coupled to the wiper for activating engagement of the wiper with the printhead when no media is detected and for deactivating the wiper when media contacts the media detection device.

BRIEF DESCRIPTION OF THE DRAWINGS

Embodiments of the present invention can be further understood by reference to the following description and attached drawings that illustrate the preferred embodiments. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description, reference is made to the accompanying drawings, which form a part hereof, and in which is shown by way of illustration a specific example in which embodiments of the invention may be practiced. It is to be understood that other embodiments may be utilized and structural changes may be made without departing from the scope of the present invention, as defined by the claims appended below.

Figure 1:
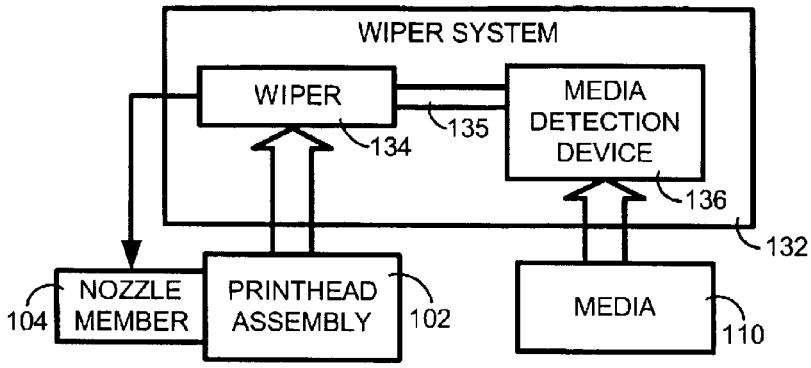
FIG. 1 is one embodiment showing a block diagram of an overall service station system.

I. General Overview:

FIG. 1 shows a block diagram of a system of one embodiment of the present invention for cleaning a printhead. The system 100 includes a printhead assembly 102 with a nozzle member 104, print media 110, a wiper system 132 including a wiper 134 mechanically coupled to a device 136 via a member 135.

The print media 110 may be any type of suitable sheet material, such as paper, card-stock, transparencies, photographic paper, fabric, mylar, and the like, but for convenience, the illustrated embodiment is described using paper as the print medium. The wiper system 132 can be a component part of an inkjet service station similar to the one described in U.S. Pat. No. 6,340,218, assigned to Hewlett-Packard Company, the current assignee, which is used to service and clean the printhead assembly 102 to increase the output quality as well as the longevity of the printhead assembly 102.

In general, during a printing operation, the printhead assembly 102 receives commands and input data from a processor (not shown) to print ink and form a desired pattern for generating text and images on the print media 110. The print media 110, through a media feed (not shown), then advances towards a print zone. During this advancement, the print media 110 engages with the device 136, which moves the wiper 134 out of the print zone into a retracted non-cleaning position. When the print media 110 leaves the print zone, if cleaning is desired, the device 136 can move the wiper 134 into a cleaning position aligned with an area on the printhead to clean the printhead 102. A resilient member may be used to resiliently fluctuate the wiper 134 from the cleaning position to the retracted non-cleaning position, depending on whether the print media is not present or present, respectively.

In particular, when the device 136 detects no print media 110 present, the wiper 134 is free to rotate into a cleaning position to allow a wiping operation. During a wiping operation, the wiper 134 is aligned with the printhead assembly 102 after the printhead assembly 102 moves through the print zone. The printhead assembly 102 then engages with the wiper 134to allow the nozzle member 104 of the printhead 102 to be accurately coupled to the wiper 134 during wiping of the printhead 102. The device 136 then deactivates the wiper 134 after the cleaning process is over or when the presence of the print media 110 is detected.

The wiper 132 includes at least one wiper blade for wiping at least one printhead assembly 102. The wiper blade is preferably made of a resilient, non-abrasive, elastomeric material, such as nitrile rubber, or more preferably ethylene polypropylene diene monomer (EPDM), or other comparable materials. Each wiper blade may have opposing sides that taper into a peaked wiping edge that engages the printhead nozzle member 104.

The wiper blades are preferably seated within a stem portion (discussed below in greater detail with reference to FIG. 4). To bias the wiper blade toward the wiper system 132, the wiper system 132 may include a biasing element or member, and a compression coil spring. During a wiping operation, the wiper blades are preferably held at an initial nominal position before engaging the printhead 102. When in an engaged position, since the wiper system 132 is locked into alignment with the printhead assembly 102, a close printhead 102 to service station (not shown) spacing with high interference can be achieved.

In addition, in some situations, a faceplate of the nozzle member can be crooked or tilted to the printhead 102 with respect to the wiper 134 or offset from front to rear (perpendicular with the scanning axis) of plane parallel with the wiper 134. Angular and/or spacing variations can be caused in part by tolerance accumulations, or less than optimal printhead seating within a carriage of the printer. In this case, since the wiper 134 is locked into alignment with the printhead assembly 102, spacing variation can be controlled.

Figure 2:
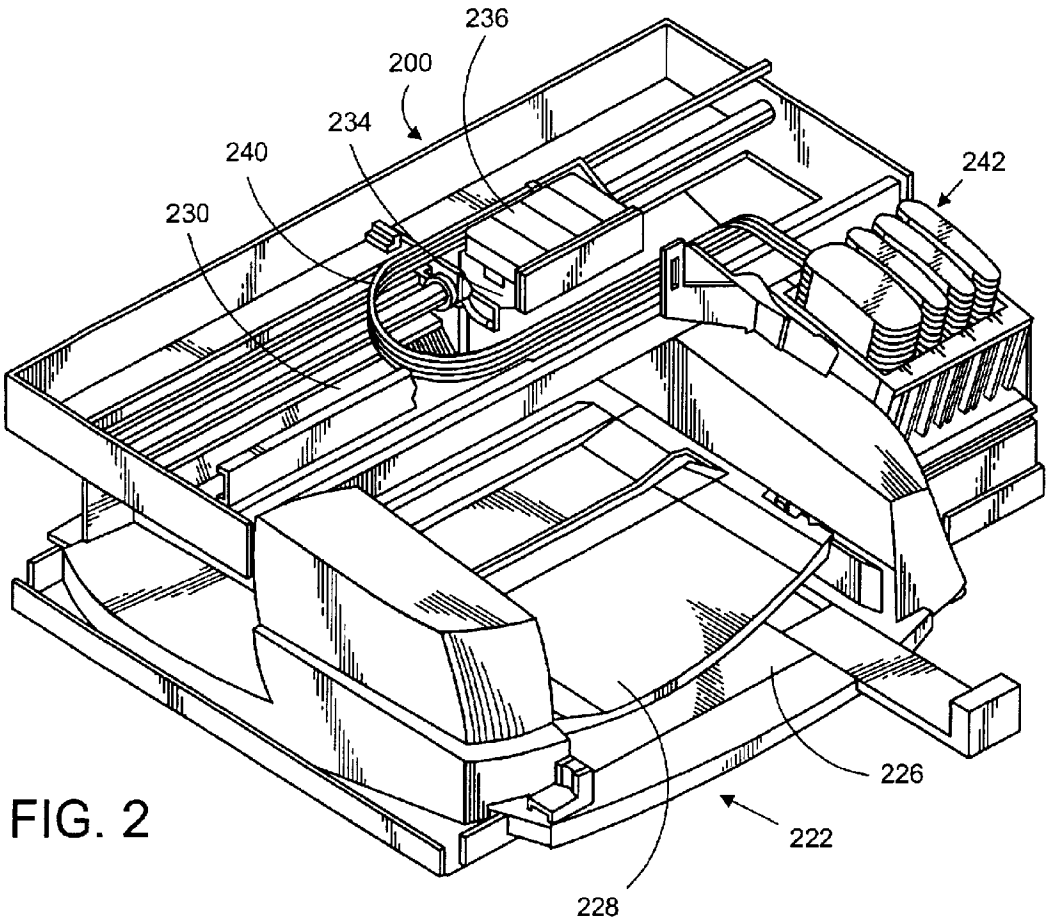
FIG. 2 is one embodiment showing an exemplary inkjet printing mechanism, here a printer that incorporates one embodiment of the invention is shown for illustrative purposes only.

II. Exemplary Printing System:

FIG. 2 is one embodiment of an exemplary inkjet printing mechanism here an "off-axis" high-speed printer that incorporates an embodiment of the invention, which is shown for illustrative purposes only. The printer 200 of FIG. 2 may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, point of sale (POS) horizontal printers and facsimile machines, to name a few, as well as various combination devices, such as a combination facsimile/printer. For convenience the concepts of the present invention are illustrated in the environment of an inkjet printer 200.

While it is apparent that the printer components may vary from model to model, the typical inkjet printer 200 includes the printhead assembly 102 of FIG. 1 and further includes a tray 222 for holding print media. When printing operation is initiated, print media, such as paper, is fed into printer 200 from tray 222 preferably using sheet feeder 226. The sheet is then brought around in a U turn and then travels in an opposite direction toward output tray 228. Other paper paths, such as a straight through paper path, can also be used.

The sheet is stopped in a print zone 230, and a carriage 234, supporting one or more printhead assemblies 236, is scanned across the sheet for printing a swath of ink thereon. After a single scan or multiple scans, the sheet is then incrementally shifted using, for example, a stepper motor or feed rollers to a next position within the print zone 230. Carriage 234 again scans across the sheet for printing a next swath of ink. The process repeats until the entire image sheet has been printed, at which point the sheet is ejected into the output tray 228.

The print assemblies 236 can be removeably mounted or permanently mounted to the carriage 234. Also, the printhead assemblies 236 can have self-contained ink reservoirs. Alternatively, each print cartridge 236 can be fluidically coupled, via flexible conduits 240, to one of a plurality of fixed or removable ink containers 242 acting as the ink supply.

III. Component Details

Figure 3A:
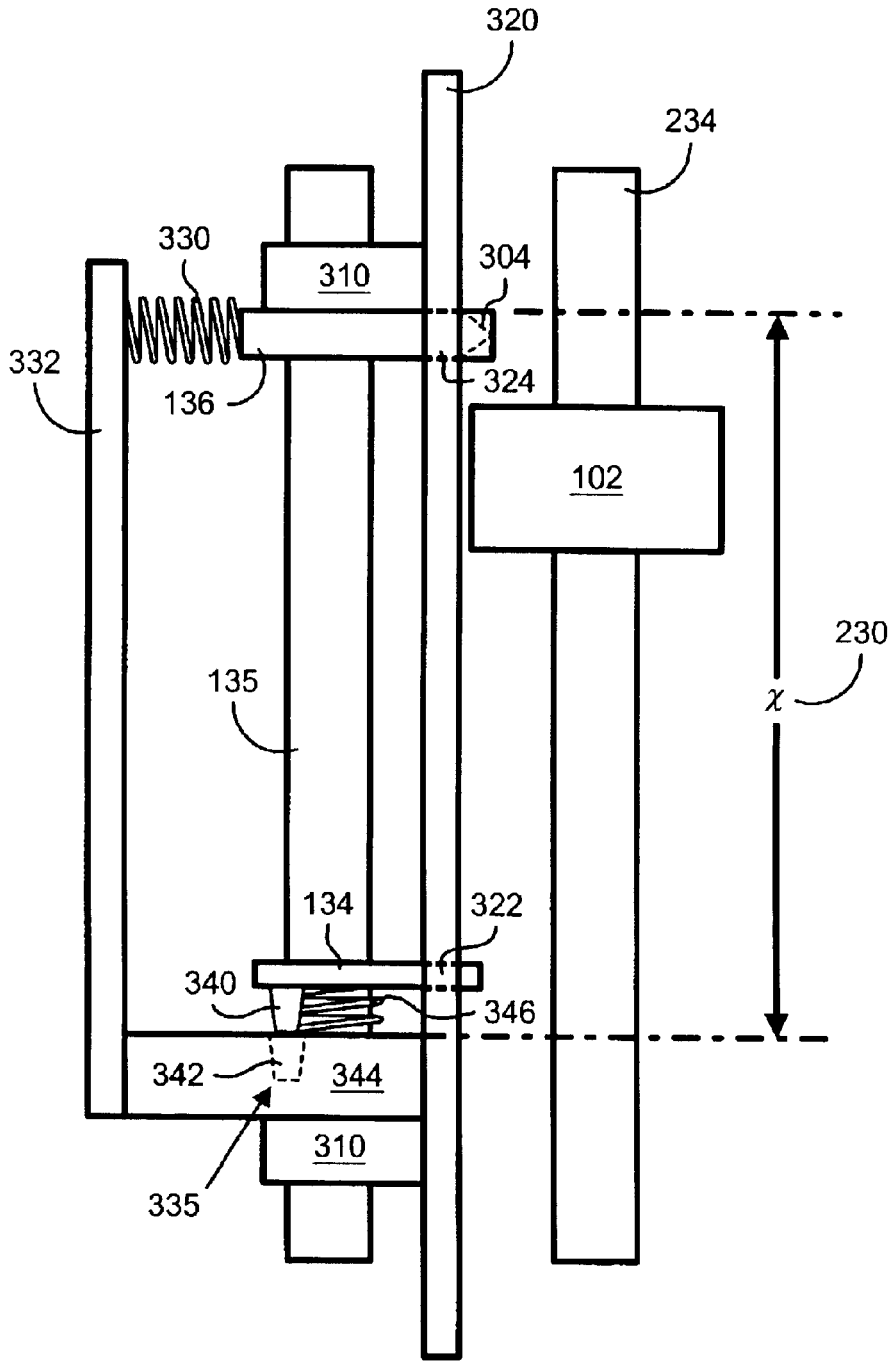
FIG. 3A is one embodiment showing for illustrative purposes only a plan view of the wiper system in position for a wiping function.

FIG. 3A is one embodiment showing for illustrative purposes only a plan view of the wiper system in position for a wiping function for a horizontal printing mechanism. In this embodiment, an embodiment of the device 136, such as a media detection device is configured as media detection device 136 with a tapered triangular shaped edge 304. This allows the paper follower 136 to act as a rotating lever when print media enters the paper path of the print zone 230 and physically contacts the tapered edge 304.

The paper follower 136 is coupled to the wiper 134 via an embodiment of the member 135, such as connecting rod. Connecting rod support members 310 are located on opposite ends of the connecting rod 135 to support and allow rotational and axial movement of the connecting rod 135. The support members 310 can be any suitable device to allow rotational and back and forth motion of the connecting rod 135, such as bearing blocks.

The wiper 134 and paper follower 136 both protrude through apertures 322, 324, respectively, within a front plate 320 located adjacent to the paper path of the print zone 230. An embodiment of a resilient member, such as spring 330 provides the paper follower 136 with a biasing action when print media enters the paper path of the print zone 230 and physically contacts the tapered edge 304. A back base 332 is located adjacent the resilient member 330, which is between the back base 332 and the paper follower 136, to allow the biasing action.

During activation of the wiper 134, the resiliently loaded paper follower 136 moves forward and protrudes through the front plate 320 when the media is not present. The connection via the connecting rod 135 between the paper follower 136 and the wiper 134 allows the two to move in unison. In this embodiment, the carriage 234 and the print zone 230, are positioned directly adjacent the front plate 320. The printhead assembly 102 traverses on the carriage 234 within the limits of the print zone 230.

When the paper follower 136 detects no print media present, the wiper 134 is free to rotate into a wiping position to allow a wiping operation. In one embodiment, during a wiping operation, the wiper 134 is locked by an embodiment of mechanism, such as a locking mechanism 335 into alignment with the printhead assembly 102 after the printhead assembly 102 moves through the print zone and engages with the wiper 134. The locking mechanism 335 includes a tapered post 340 that mates with a locating alignment hole 342 within a tab member 344. A return spring 346 allows resilient biasing of the wiper 132 for locking and unlocking the wiper with the locking mechanism 335 during engagement and disengagement of the wiper 134 with the printhead assembly 102.

Figure 3B:
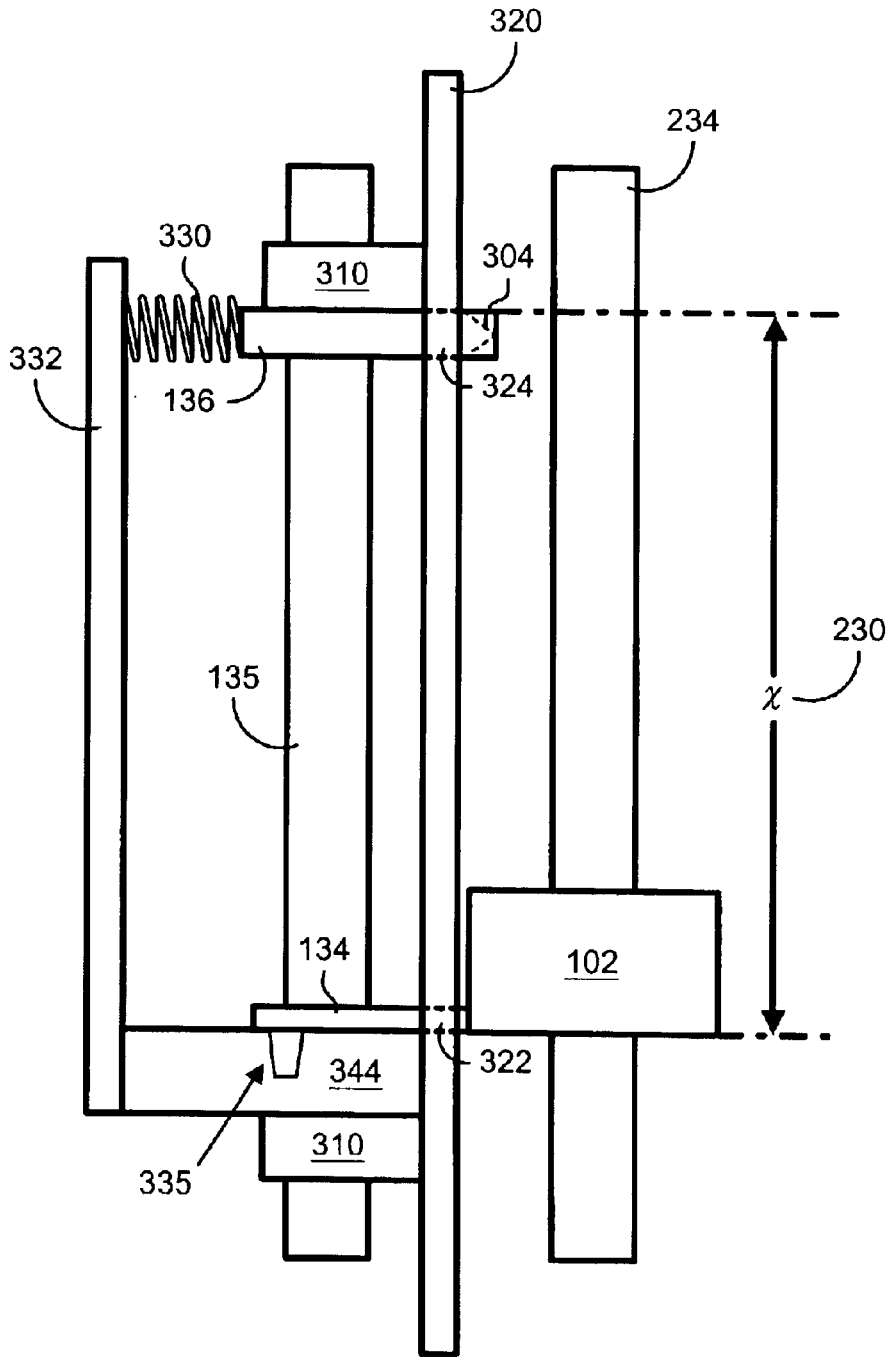
FIG. 3B is one embodiment showing for illustrative purposes only a plan view where the media detection device has activated the wiper.

FIG. 3B is one embodiment showing for illustrative purposes only a plan view where the media detection device has activated the wiper. Referring to FIG. 3A along with FIG. 3B, before a wiping operation, the carriage 234, which carries the printhead 102, is in a position between the paper follower 136 and the wiper 134. When wiping is requested, the carriage 234 moves towards the wiper 134 until contact is made. When contact is made, the locking mechanism 335 is activated.

The contact pushes the wiper 134 in the direction of the carnage motion causing the tapered post 340 to enter the locating alignment hole 342. This secures the wiper 134 in the correct position during wiping. The nozzle member passes over the wiper 134 removing any debris on the nozzle member.

When the printhead 102 has moved past the wiper 134, the return spring 346 of FIG. 3A resiliently disengages the tapered post 340 from the locating alignment hole 342 to return to a non-wiping position when the wiping function is done. The system could also be disengaged from the tapered post 340 by reversing the direction of the wipe, however since unidirectional wiping is preferred for cleaning, a return spring is preferred.

Figure 3C:
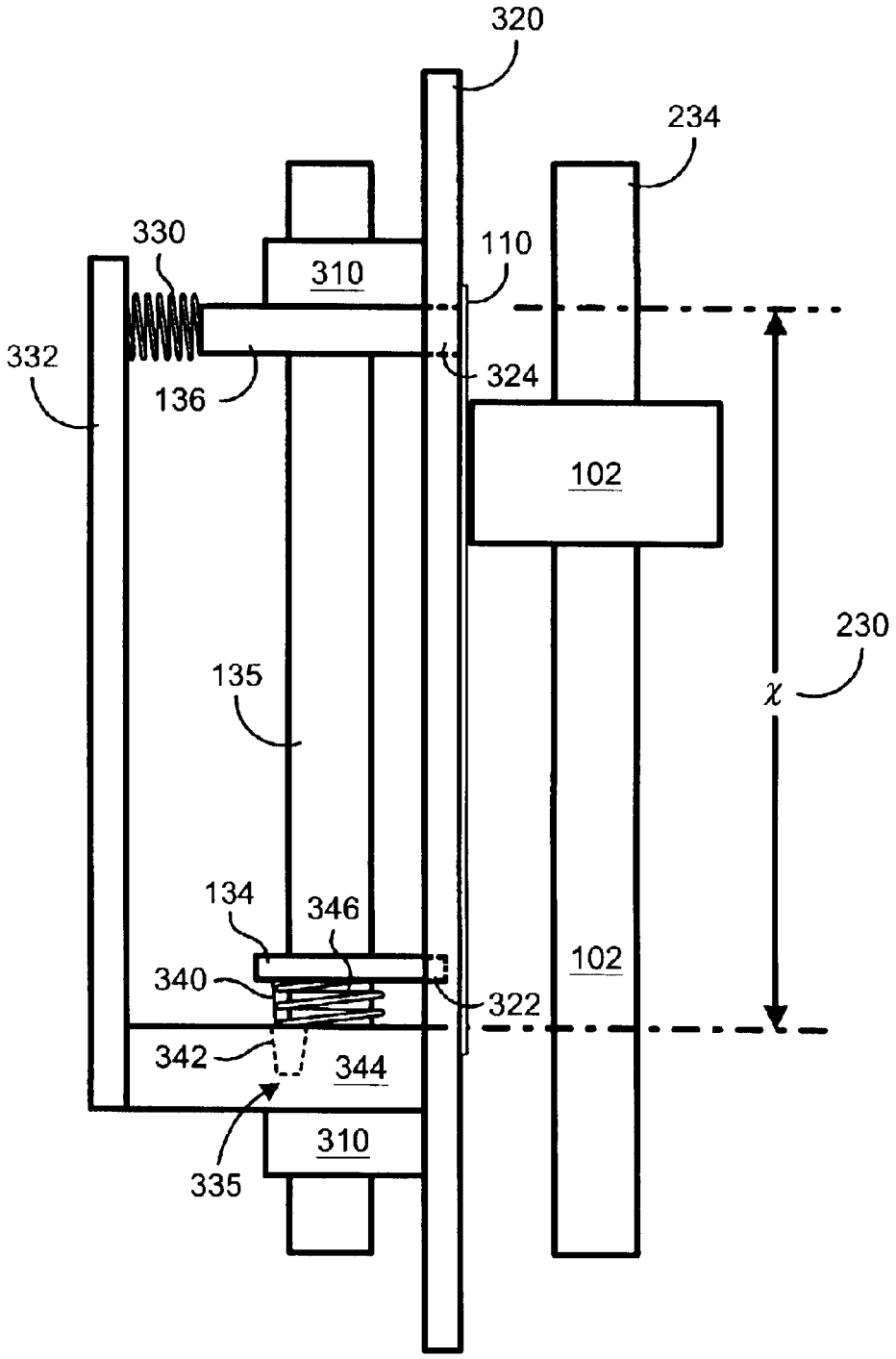
FIG. 3C is one embodiment showing for illustrative purposes only a plan view where the media detection device has deactivated the wiper.

FIG. 3C is one embodiment showing for illustrative purposes only a plan view where the media detection device has deactivated the wiper. Referring to FIGS. 3A and 3B along with FIG. 3C, when the paper follower 136 detects the presence of print media 110, the paper follower 136 deactivates the wiper 134. Namely, when the media engages the paper follower 136, it moves the paper follower 136 to a position flush with the front plate 320 and the wiper 134 is moved to a position slightly behind the front plate 320. This allows the media to advance freely. The distance from the paper follower 136 to the wiper 134 is greater than the width of the printhead assembly 102 to allow it to be positioned between the paper follower 136 and the wiper 134 prior to beginning a printhead cleaning. This prevents the printhead from contacting the paper follower 136 during wiping.

What is claim is:

1. A cleaning system for an inkjet printhead, comprising:

a wiper; and a media detection device coupled to the wiper for activating engagement of the wiper with the printhead when no media is detected and for deactivating the wiper when media contacts the media detection device.

2. The cleaning system of claim 1, wherein the media detection device includes a paper follower that senses contact between itself and the media for detecting the presence of the media.

3. The cleaning system of claim 1, further comprising a locking mechanism that locks the wiper into alignment with the printhead when the printhead engages with the wiper.

4. The cleaning system of claim 3, wherein the locking mechanism includes a tapered post that is fitted into a mating hole.

5. The cleaning system of claim 1, further comprising a resilient member coupled between the media detection device and a back base.

6. The cleaning system of claim 5, wherein the resilient member includes an engagement spring.

7. The cleaning system of claim 5, where the back base receives and engages with the wiper when the media detection device detects the presence of print media.

8. The cleaning system of claim 7, wherein the back base is integrated with an inkjet printing mechanism housing the inkjet printhead.

9. The cleaning system of claim 5, wherein deactivating the wiper includes rotation of the wiper behind the back base.

10. The cleaning system of claim 1, wherein the media physically engages with the media detection device when the print media enters a print zone.

11. The cleaning system of claim 1, wherein the media detection device has a rotating lever with a tapered triangular shaped edge.

12. The cleaning system of claim 11, wherein when the media enters a media path of a print zone, it contacts with the tapered triangular shaped edge.

13. The cleaning system of claim 1, further including a connecting rod coupling the media detection device to the wiper.

14. The cleaning system of claim 13, further including connecting rod support members located on opposite ends of the connecting rod to support and allow rotational and axial movement of the connecting rod.

15. The cleaning system of claim 14, wherein the support members are bearing blocks that allow rotational and back and forth motion of the connecting rod.

16. The cleaning system of claim 1, wherein the wiper and media detection device both protrude through respective apertures within a front plate located adjacent to a media path of a print zone.

17. An inkjet printing mechanism, comprising:

an ink supply;

a fluid ejection mechanism for ejecting ink from the ink supply;

a cleaning device including a flexible wiper blade for cleaning the fluid ejection mechanism;

an activation device that activates the flexible wiper blade when media is not detected; and a deactivation device that deactivates the flexible wiper blade when media contacts the deactivation device.

18. The inkjet printing mechanism of claim 17, further comprising an alignment locking device that locks the wiper into alignment with the fluid ejection mechanism during cleaning of the fluid ejection mechanism.

19. The inkjet printing mechanism of claim 17, wherein the media engages with the deactivation device when the media enters a print zone.

20. The inkjet printing mechanism of claim 17, further comprising a back base that engages with the flexible wiper blade when the deactivation device detects the media.

21. The inkjet printing mechanism of claim 17, wherein the deactivation device is configured to automatically and simultaneously deactivate the flexible wiper blade when sensing contact between itself and the media.

22. A method for cleaning an inkjet printhead with a wiper device, the method comprising:

determining the presence of media with a paper follower;

moving the wiper device into a cleaning position when no media is present;

engaging the wiper device with the printhead; and moving the wiper device into a non-cleaning position when the media contacts with the paper follower.

23. The method of claim 22, further comprising locking the wiper device into alignment with the printhead after the printhead engages with the wiper device.

24. The method of claim 22, wherein the wiper device is resiliently moved into a non-cleaning position with an engagement spring.

25. The method of claim 22, wherein the wiper device is rotated behind a back base when the paper follower contacts with the media.

26. A wiper system for cleaning an inkjet printhead, comprising:

means for activating the wiper system when the wiper system determines that media is not present;

means for engaging with and cleaning the inkjet printhead when the wiper system is activated; and means for deactivating the wiper system when media contacts the wiper system and is present.

27. The wiper of claim 26, further comprising means for locking the wiper system into alignment with the inkjet printhead when the inkjet printhead engages with the wiper.

28. The wiper of claim 26, wherein the media engages with the means for deactivating the wiper system when the media enters a print zone.

29. The wiper of claim 26, further comprising means for rotating the wiper system behind a back base when the wiper system contacts with the media.

30. The wiper system of claim 26, further comprising means for resiliently deactivating the wiper.

31. A method for cleaning an inkjet printhead, comprising:

activating a wiper into cleaning engagement with the printhead when no media is detected by a paper follower; and deactivating the wiper into a non-cleaning position when media contacts the the paper follower.

32. The method of claim 31, further comprising locking the wiper into secure alignment with the inkjet printhead when the inkjet printhead is activated into cleaning engagement with the wiper.

33. The method of claim 31, further comprising detecting the presence of the media by sensing contact between the paper follower and the media.

34. The method of claim 31, further comprising resiliently deactivating the wiper when the media contacts the paper follower.

35. The method of claim 31, further comprising contacting the paper follower with the media when the media enters a print zone.

36. A cleaning system for an inkjet printhead, comprising:

an elastomeric wiper blade;

a paper follower coupled to the elastomeric wiper blade that senses contact between itself and media for detecting the presence of the media;

a spring coupled to the paper follower for resiliently engaging the wiper with the printhead when no media is detected by the paper follower and for resiliently deactivating the elastomeric wiper blade when media contacts the paper follower; and a locking mechanism having a tapered post that is fitted into a mating hole to lock the elastomeric wiper blade into alignment with the printhead when the printhead resiliently engages with the wiper.

37. The cleaning system of claim 36, wherein the paper follower has a rotating lever with a tapered triangular shaped edge so that the media contacts with the tapered triangular shaped edge when it enters a media path of a print zone.

* * * * *